US008650819B2

(12) United States Patent
Yegge

(10) Patent No.: US 8,650,819 B2
(45) Date of Patent: Feb. 18, 2014

(54) PROCESS FOR PRODUCING HIGH-CAPACITY CONCRETE BEAMS OR GIRDERS

(76) Inventor: Lawrence R. Yegge, Lincoln, CA (US)

( * ) Notice: Subject to any disclaimer, the term of this patent is extended or adjusted under 35 U.S.C. 154(b) by 461 days.

(21) Appl. No.: 12/925,681

(22) Filed: Oct. 27, 2010

(65) Prior Publication Data

US 2011/0099941 A1 May 5, 2011

Related U.S. Application Data

(60) Provisional application No. 61/280,109, filed on Oct. 29, 2009.

(51) Int. Cl.
*E04C 5/08* (2006.01)
*E04C 5/12* (2006.01)

(52) U.S. Cl.
USPC ..... 52/223.14; 52/223.13; 52/223.8; 52/837

(58) Field of Classification Search
USPC ..... 52/223.1–223.12, 223.13–223.14, 52/745.19, 745.17, 745.21, 747.1, 837, 52/841, 849, 838, 223.7, 223.6, 223.8, 52/223.9; 14/77.1, 74.5, 73
See application file for complete search history.

(56) References Cited

U.S. PATENT DOCUMENTS

| | | | | | |
|---|---|---|---|---|---|
| 2,010,015 | A * | 8/1935 | Fletcher | 442/146 |
| 3,465,484 | A * | 9/1969 | Jolliffe et al. | 52/127.1 |
| 3,944,242 | A * | 3/1976 | Eubank | 280/30 |
| 4,574,545 | A * | 3/1986 | Reigstad et al. | 52/223.6 |
| 4,646,379 | A * | 3/1987 | Muller | 14/23 |
| 4,709,435 | A * | 12/1987 | Stemler et al. | 14/73 |
| 7,475,446 | B1 * | 1/2009 | He | 14/77.1 |
| 8,020,235 | B2 * | 9/2011 | Grace | 14/74.5 |

* cited by examiner

*Primary Examiner* — Jeanette E. Chapman
(74) *Attorney, Agent, or Firm* — William C. Milks, III

(57) ABSTRACT

A prescribed prestressing process is employed to construct precast concrete beams and girders. The process is utilized where an early concrete strength is too low for transfer of the full pre-tensioning force on a daily schedule to avert an otherwise serious and costly production delay. The process described provides the producer a reliable way of making beams and girders that are prestressed to take advantage of the higher concrete strength characteristics. The consequent economic advantage of higher structural capacity beams and girders is thereby realized. Additionally, beam or girder camber is controlled by the process, fostering production of a superior quality product.

14 Claims, 6 Drawing Sheets

TYPICAL SECTION AT MIDSPAN (SECTION DEPTH OF 60" SHOWN)

TABLE OF PROPERTIES AND DIMENSIONS

| "D" (in) | "h" (in) | A (in²) | I (in⁴) | "Yb" (in) | "Yt" (in) | Sb (in³) | St (in³) | r (in) | w (lb/ft) |
|---|---|---|---|---|---|---|---|---|---|
| 54 | 19.62 | 1136 | 443,113 | 27.30 | 26.70 | 16,231 | 16,596 | 19.75 | 1,183 |
| 60 | 25.62 | 1184 | 579,209 | 30.32 | 29.68 | 19,101 | 19,517 | 22.12 | 1,233 |
| 66 | 31.62 | 1232 | 736,620 | 33.34 | 32.66 | 22,091 | 22,557 | 24.45 | 1,283 |
| 72 | 37.62 | 1280 | 916,212 | 36.36 | 35.64 | 25,196 | 25,710 | 26.75 | 1,333 |
| 78 | 43.62 | 1328 | 1,118,846 | 39.38 | 38.62 | 28,410 | 28,972 | 29.02 | 1,383 |
| 84 | 49.62 | 1376 | 1,345,388 | 42.40 | 41.60 | 31,732 | 32,340 | 31.72 | 1,433 |
| 96 | 61.62 | 1472 | 1,873,650 | 48.43 | 47.57 | 38,688 | 39,387 | 35.68 | 1,533 |

TYPICAL SECTION AT MIDSPAN (SECTION DEPTH OF 60" SHOWN)

TABLE OF PROPERTIES AND DIMENSIONS

| "D" (in) | "h" (in) | A ($in^2$) | I ($in^4$) | "Yb" (in) | "Yt" (in) | Sb ($in^3$) | St ($in^3$) | r (in) | w (lb/ft) |
|---|---|---|---|---|---|---|---|---|---|
| 54 | 19.62 | 1136 | 443,113 | 27.30 | 26.70 | 16,231 | 16,596 | 19.75 | 1,183 |
| 60 | 25.62 | 1184 | 579,209 | 30.32 | 29.68 | 19,101 | 19,517 | 22.12 | 1,233 |
| 66 | 31.62 | 1232 | 736,620 | 33.34 | 32.66 | 22,091 | 22,557 | 24.45 | 1,283 |
| 72 | 37.62 | 1280 | 916,212 | 36.36 | 35.64 | 25,196 | 25,710 | 26.75 | 1,333 |
| 78 | 43.62 | 1328 | 1,118,846 | 39.38 | 38.62 | 28,410 | 28,972 | 29.02 | 1,383 |
| 84 | 49.62 | 1376 | 1,345,388 | 42.40 | 41.60 | 31,732 | 32,340 | 31.72 | 1,433 |
| 96 | 61.62 | 1472 | 1,873,650 | 48.43 | 47.57 | 38,688 | 39,387 | 35.68 | 1,533 |

PROCESS FOR PRODUCING HIGH-CAPACITY CONCRETE BEAMS OR GIRDERS

CROSS-REFERENCE TO RELATED PATENT APPLICATION

This application relates to U.S. Provisional Patent Application No. 61/280,109 filed on Oct. 29, 2009, entitled A METHOD FOR PRODUCING HIGH-CAPACITY CONCRETE BEAMS, which is hereby incorporated herein in its entirety by this reference.

FIELD OF THE INVENTION

The present invention relates generally to the prefabrication of structural building materials, and, more particularly, to the prefabrication of concrete beams or girders. Specifically, various embodiments of the present invention provide an apparatus and process to realize economic and quality benefits by producing concrete beams or girders of high structural capacity through practical steps that are easily implemented in most precast beam/girder production plants.

BACKGROUND OF THE INVENTION

Progress in the production of concrete beams (also known as "girders") for construction of bridges and buildings was greatly stimulated in the 1950's when the technique of prestressing the concrete was proven to have advantages in the United States. There are two known techniques of prestressing: pre-tensioning and post-tensioning. Both techniques of prestressing employ steel cables or bars to apply and hold a concrete member in compression. Prestressing can be referred to as "active reinforcement" as compared to "passive reinforcement", such as is obtained with mild reinforcing steel (rebar).

Pre-tensioning is the predominate form of prestressing employed in the precast concrete industry. This technique involves stretching steel cables with a high tensile force, with the cables held between fixed abutments that are situated at each end of a casting platform, or "bed", and placing concrete in forms on the bed, which forms encase the cables to form a beam or girder. At a later time, after the concrete has gained sufficient strength and bonded well to the cables, the cables are released from the abutment anchors, the forms removed, and the completed beam or girder is lifted from the bed.

It is of great economic importance that this procedure be completed on a daily cycle. In order to do this, heating the newly cast concrete at a curing temperature as high as 180 degrees F. to accelerate concrete strength gain has been a common practice.

The post-tensioning technique is not generally practiced in precast concrete production. Post-tensioning is more expensive per pound than pre-tensioning, so it has been employed sparingly in the production of beams or girders other than in special cases to meet design requirements.

In recent years, there has been remarkable progress in making concrete that has much higher strength than ever before. Ultimate 56 day compressive strength is now possible in the 10,000 psi to 20,000 psi range, which is up to 10,000 psi higher than strengths attainable a short time ago.

However, there has not been an advantage taken of higher strength concrete by employing a proportionately higher prestressing force in the design of precast beams or girders. Beam or girder load carrying capacity is increased dramatically when, using the same beam or girder size and shape as those made with "standard" concrete, stronger high performance concrete (HPC) is employed with a substantially greater prestressing force. This fact was demonstrated on an experimental bridge project where HPC beams having a 56 day strength of 13,600 psi were constructed with approximately 60 percent more prestressing force than standard beams made with 6,000 psi concrete. Test results proved that four HPC beams had the same load carrying capacity as seven standard beams for "twin" bridges of an identical span and roadway width. Although the cost per beam was higher for the HPC beams, the cost of the bridge superstructure having four high structural capacity beams was approximately 15% lower than the bridge having seven standard beams. This project confirmed the economic viability of employing higher structural capacity beams made with superior concrete strength and constructed with a high prestressing force. However, industry has not reaped the benefits of these features to achieve an improved and more economic product. There are certain problems that must be solved.

In addition to the common precautions observed in the design of a concrete mix, there are two important factors that must be dealt with concerning concrete durability. Both of these factors pose potential problems in making durable concrete beams or girders, as well as other concrete members. The first is known as alkaline-silica reaction (ASR); the second is called delayed ettringite formation (DEF). ASR is caused in large part by high alkalinity in the concrete reacting over time with silica in the aggregate. In severe cases, which are not uncommon, this reaction results in cracking and destruction of the concrete.

On the other hand, it has been learned recently that DEF is promoted principally by curing the concrete at a very high temperature. DEF typically occurs over time in mature concrete. It has been mistakenly identified as ASR in some cases, because its apparent failure mode is similar to the failure mode attributable to ASR.

The solutions to both problems are now known. Damage due to ASR can be avoided by substituting another cementitious material such as fly ash or slag for a portion of the cement in the mix to reduce net alkalinity. The drawback to this approach is that early concrete strength gain is slowed. Although final strength is typically very high, the concrete strength required for transfer of stress (the "release strength"), is not reached in time for daily recycling on the prestressing bed. Daily recycling of the bed is critical to a beam or girder manufacturer's economics.

DEF can be avoided by restricting concrete curing temperature to a maximum of approximately 160 degrees F. Here again, because early concrete strength gain is dependent on curing temperature, the lower temperature requirement makes attaining release strength overnight less likely.

Thus, there are two factors that have constrained production of superior and more cost-effective beams or girders prefabricated with HPC. Since higher strength concrete beams or girders containing a high prestressing force have been shown to produce a significant lower cost for a completed structure, it is important to have a way of making prestressed HPC beams or girders on a daily production cycle.

Control of camber in concrete beams or girders can be yet another serious problem. Camber is the arching upward of a beam/girder or slab that is prestressed when the prestressing force is located below the centroid of the concrete. In almost all cases, the pre-tensioning force applied to a beam or girder on a pre-tensioning bed is well below the centroid of the concrete. When a prestressing force (which is a compressive force) is applied to concrete, the concrete immediately shortens elastically as the force is applied. Thereafter, there is an inelastic shortening due to a phenomenon known as "creep" of the concrete. The amount of creep is a function of time, the level of compressive stress, and the modulus of elasticity of the concrete. Camber takes place in a prestressed concrete beam or girder when the concrete fibers in the lower portion of the member are under a higher compressive stress than the fibers in the upper portion. Creep of the concrete continues to shorten the bottom of the member as time passes, causing camber to grow. There have been cases where camber growth has been so great that beams or girders became unfit for use in structures and were rejected. The economic implications of such a problem go well beyond loss of money by the precaster having to manufacture substitute beams or girders. The construction company, depending upon timely delivery of product for constructing the bridge or building, is impacted by delay that ensues while new beams or girders are manufactured to replace the rejected ones.

One objective of the present invention is to provide a process that can be readily implemented by beam or girder manufacturers to overcome these problems.

SUMMARY OF THE INVENTION

The various embodiments of the present invention provide a process for making precast beams or girders that have a greater load carrying capacity by employing a strategy that also provides additional control of quality. The process described makes it practical to use higher strength concrete that carries a high prestressing force. A substantial advantage is obtained by the following combination of steps to achieve superior load carrying capacity and quality and achieve advantageous economic results.

First, the full prestressing force required by the design requirements for a beam or girder is not introduced by pre-tensioning, as is now routinely done. Instead, only a portion of the full design force is applied by pre-tensioning while the beam or girder is on a prestressing bed. A pre-tensioning force is applied that is at least a magnitude that will allow the beam or girder to be removed from the bed and withstand stresses experienced in handling and storage. The pre-tensioning force needed is readily calculated as a part of production procedures as is well-known to persons skilled in the art.

The purpose of applying only a partial prestressing force is to allow earlier release of the pre-tensioning cables or rods, which release is made possible because the prestressing force that is applied to the concrete by pre-tensioning is reduced and thus permits the concrete strength to be lower before release of cables or rods from the abutments. Thus, the concrete beam or girder, although having an initial lower strength, can be removed from the bed earlier. Also, the effects of low early concrete strength that is caused by adjusting the concrete mix to diminish the prospect of ASR, and the lower curing temperature to combat DEF, as well as other factors that result in a concrete strength too low to carry the full prestressing force, are effectively managed, while daily cycling of the bed is achieved.

Second, after a beam or girder is removed from the bed, the beam or girder is stored on supports near its ends, so that gravity acting on the beam or girder counteracts most of the prestressing force and thus resists camber growth due to flexural stresses. The result is that little, if any, inelastic concrete creep and camber growth occurs over time.

Third, the remainder of the required prestressing force for the beam or girder is induced by post-tensioning. Post-tensioning can be accomplished at any time of the manufacturer's choosing, typically just several days before shipping the beam or girder to a customer's jobsite. By this timing strategy, unwanted camber growth can be eliminated.

An added operational advantage produced by this process is that post-tensioning is performed away from the casting area at a distance from the prestressing bed, and therefore it is not on a critical production path because it does not affect the high intensity core activity of the beam or girder manufacturer. Also, because a range of post-tensioning forces can be applied, the manufacturer can potentially build an inventory of partially constructed beams or girders and thus supply beams or girders to customers more quickly than if construction of the beams or girders had not yet begun.

The foregoing and other objects, features, and advantages of the present invention will become more readily apparent from the following detailed description of various embodiments of the present invention, which proceeds with reference to the accompanying drawing.

BRIEF DESCRIPTION OF THE DRAWINGS

The various embodiments of the present invention will be described in conjunction with the accompanying figures of the drawing to facilitate an understanding of the present invention. In the figures, like reference numerals refer to like elements. In the drawing:

FIG. 1, comprising

FIG. 2, comprising

DETAILED DESCRIPTION OF THE PREFERRED EMBODIMENTS

Figure 1A:
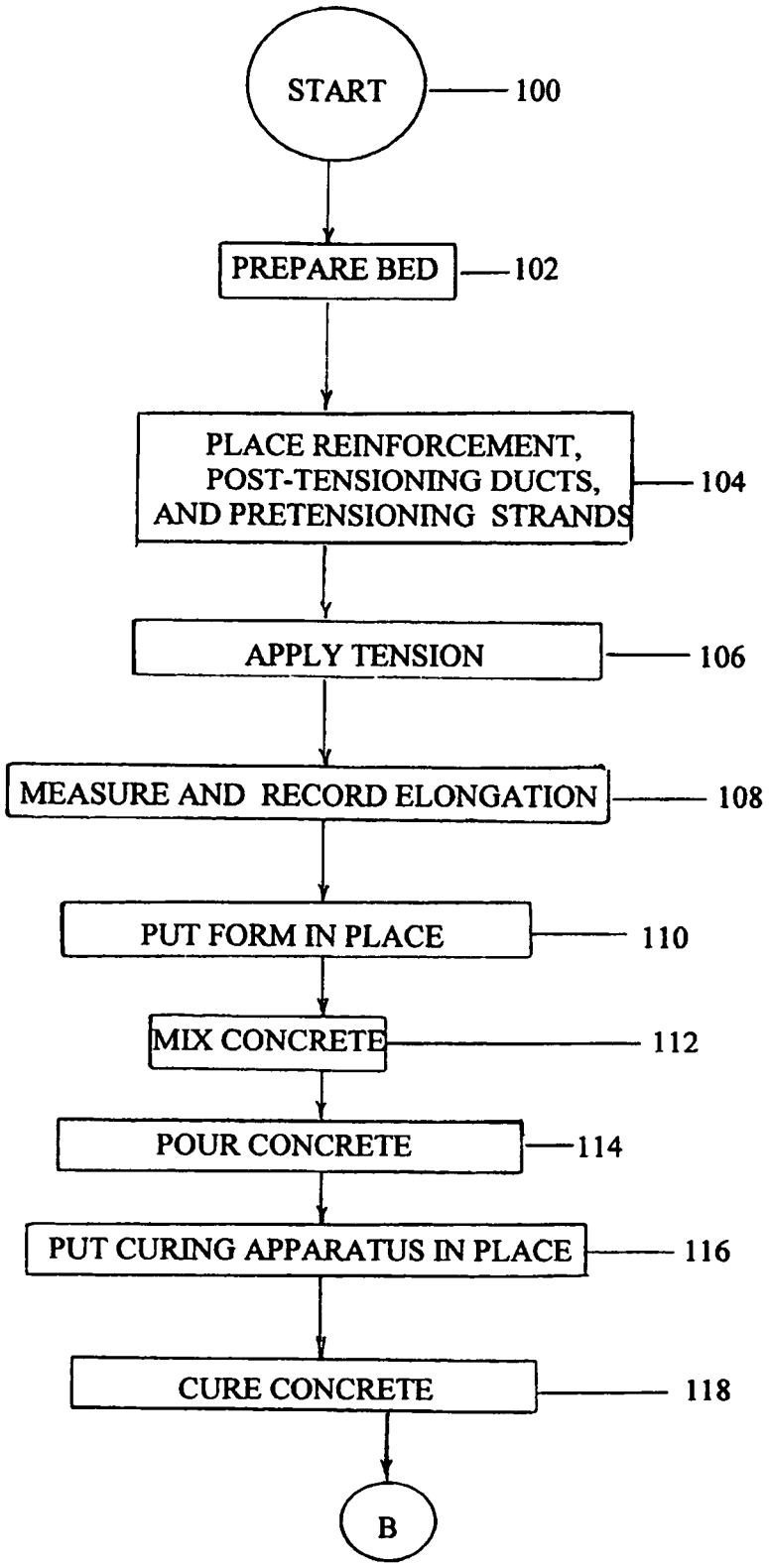
FIGS. 1A, 1B, and 1C, illustrates the basic process flow for beam or girder production in accordance with one embodiment of the present invention.
Figure 1B:
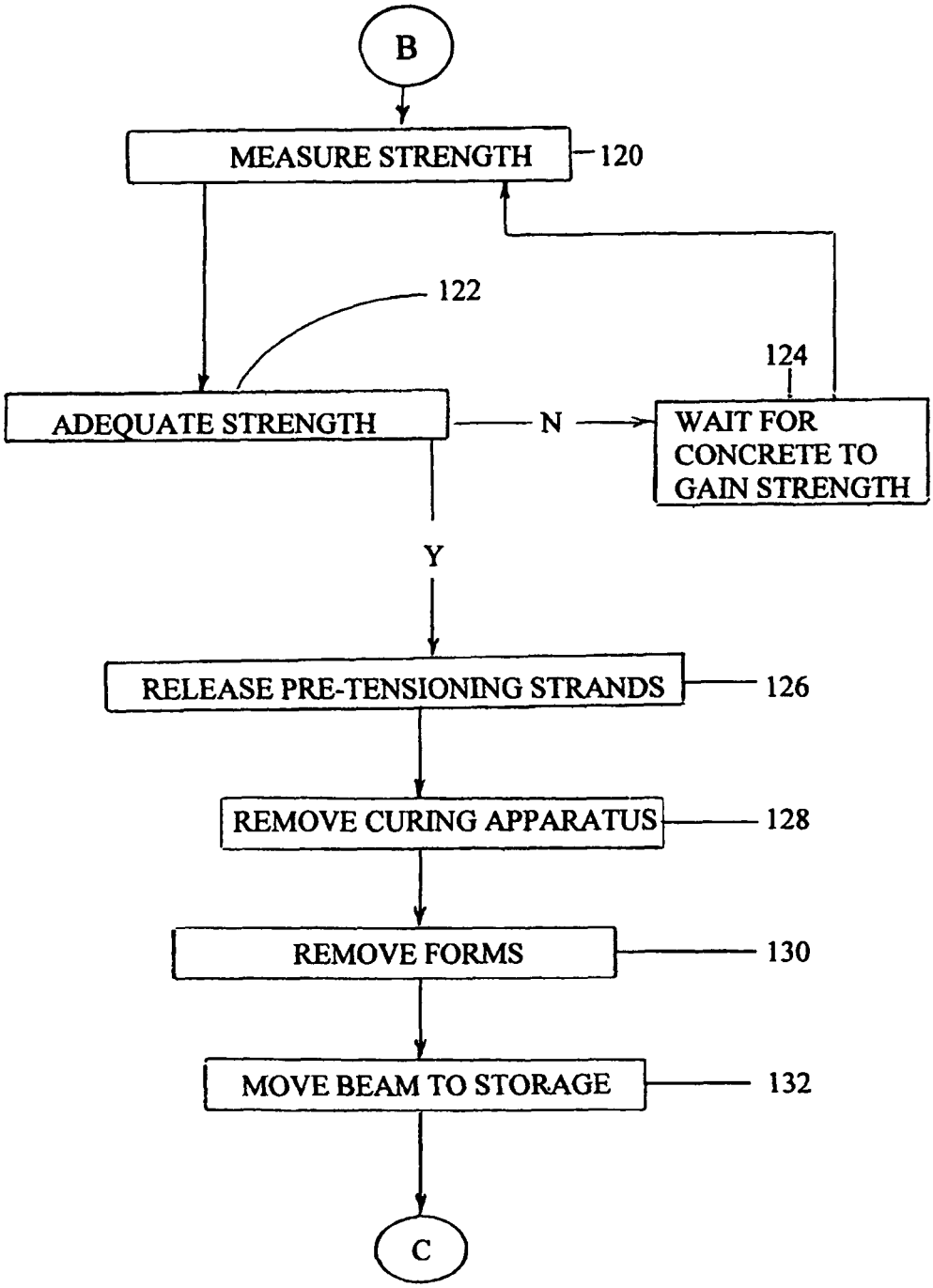
Figure 1C:
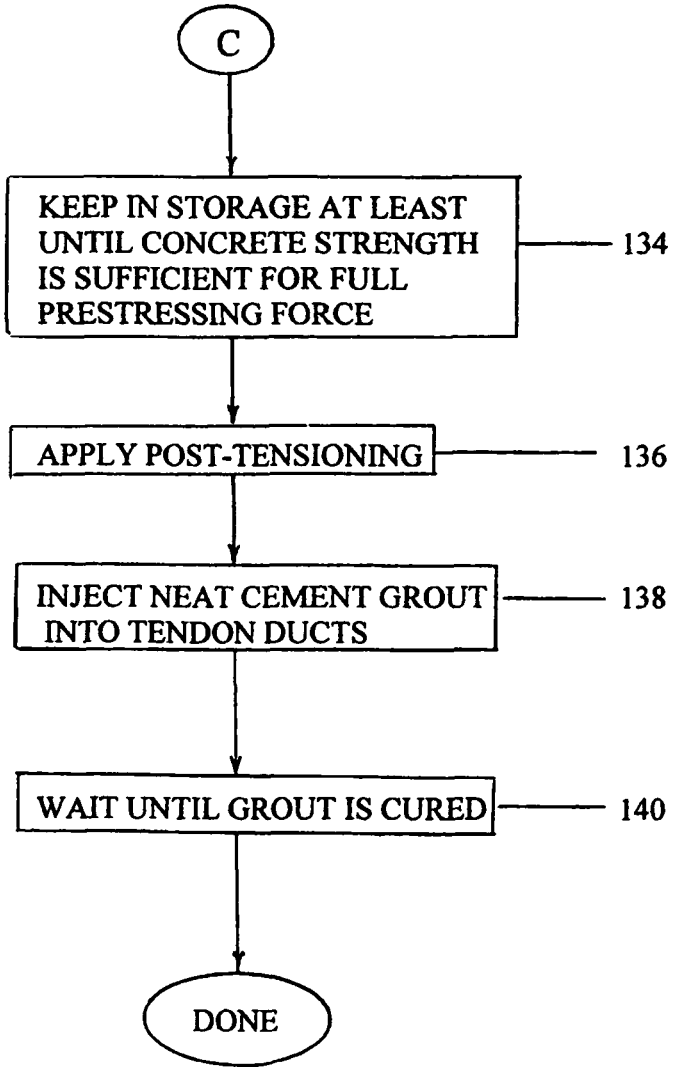

FIGS. 1A, 1B, and 1C illustrate a flowchart depicting a non-limiting example of the manufacturing process for a high strength concrete beam or girder, which synergistically allows for the use of high strength concrete combined with a rapid and economical cycling of the manufacturing bed, while providing a beam or girder strength that takes full advantage of the high strength concrete.

The example process of FIG. 1 begins in a step or operation 100, as shown in FIG. 1A, and continues in an operation 102 in which the manufacturing bed is prepared for use. Then, in an operation 104, reinforcement and pre-tensioning strands, for example, cables or rods, are installed in place on the bed, along with post-tensioning ducts, and anchorages. Next, in an operation 106, tensile force is applied to the pre-tensioning strands that were deployed in operation 104. In an operation 108, the elongation of the pre-tensioning strands is measured and recorded. An operation 110 is then performed which assembles the forms in place on the bed to provide a structure that determines the beam or girder shape.

In an operation 112, the high strength concrete is mixed. In certain example embodiments, a high cementitious content is used, along with water-reducing and plasticizing admixtures. The cementitious material in certain example embodiments comprises, for example, Portland Cement. In certain example embodiments a portion of the cementitious material comprises an alkalinity reducing material such as, for example, fly ash or slag to prevent the alkalinity of the mixture from being too high. Otherwise, alkalinity can cause a very serious reaction with silica in the aggregate, resulting in severe cracking of the concrete. While the introduction of the alkalinity reducing material does not materially affect the ultimate strength of the resultant concrete, the strength of the concrete is reduced in the short term, and other measures described herein are preferably taken to compensate for the short term lack of strength and its impact on the manufacturing process. The result is a synergistic combination that provides a beam or girder that takes full advantage of the strength of the highly cementitious mixture, avoids a silica reaction, and yet allows a rapid cycling of the manufacturing bed.

In an operation 114 the concrete mixture is poured into the form. A portion of the mixture is also poured into a number of cylindrical or cubical forms which allow the strength of the concrete to be sampled at various times. The curing apparatus is put in place in an operation 116. Then, in an operation 118 the concrete is cured.

As shown in FIG. 1B, the strength of the concrete is measured in an operation 120, typically using one or more of the concrete cylinders or blocks mentioned in the description of operation 114. A decision operation 122 determines whether the concrete has achieved a strength that is at least adequate to endure pre-tensioning (the "release strength"), removal from the bed, and storage. If it is determined that the strength of the concrete is not adequate, then a wait operation 124 is performed to allow the concrete to gain more strength, and the process returns to operation 120. If it is determined in operation 122 that the strength of the concrete has achieved a strength that is at least adequate to endure pre-tensioning, removal from the bed, and storage, then the process continues with operation 126 which releases the pre-tensioning strands from their abutment anchorages, thus placing the beam or girder under compression.

Next, in an operation 128, the curing apparatus is removed to allow access to the beam or girder. Thereafter, in an operation 130 the forms are removed and cleaned for reuse. Then, in an operation 132, the beam or girder is moved to storage. In certain example embodiments, the beam or girder is placed on supports proximate to the beam's or girder's respective ends, which allows the beam or girder to avoid camber growth, since the force applied in operation 106 is of less than full magnitude. The beam or girder, having gained sufficient strength to support its own weight and avoid deflection can be stored indefinitely. This removal of the beam or girder from the bed permits the bed to be re-used, and allows the beam or girder to gain strength over a period of time in storage. The timing of the removal from the bed is earlier than would otherwise be possible, and this early removal allows the bed to be used again for making another beam or girder. The removal of the beam or girder from the bed can be performed when the high strength concrete is relatively weak, because the pre-tensioning strands that were released in operation 126 have imparted only a portion of the total eventual prestressing force, yet a sufficient force for removing the beam or girder from the bed. The pre-tensioning in operation 126, which imparts only a portion of the full prestressing force, thus synergistically allows high strength materials to be used even though those materials are relatively weak on the day after casting.

As described above, in the operation 132 the beam or girder is moved to storage and placed, for example, on supports proximate to the ends of the beam or girder in order to limit camber growth. An operation 134 shown in FIG. 1C is performed wherein the beam or girder is kept in storage while it gains strength sufficient for the full prestressing force. The amount of storage time can vary dependent on the formulation of the materials of the concrete, and also can vary with strength requirements for the beam or girder. The beam or girder can be allowed to gain strength over any desired amount of time in order to take advantage of the strength potential of the materials used, or meet time constraints that call for beams or girders of lesser strength in a relatively short amount of time. Next, in an operation 136 a post-tensioning force is applied. Then, in an operation 138 cement grout is injected into the tendon ducts employed in post-tensioning. Next, in an operation 140 the grout is allowed to cure over a period of time. Finally, the process is concluded in an operation 142.

Figure 2A:
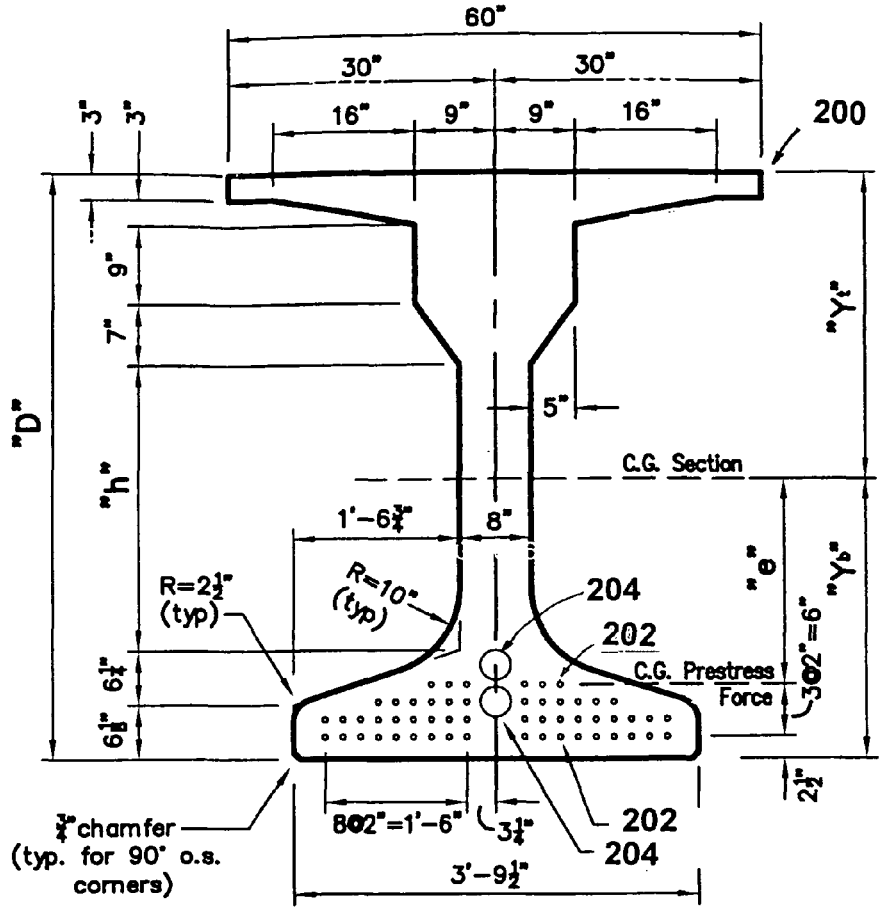
FIGS. 2A and 2B, shows an embodiment of a beam or girder produced in accordance with the process of the invention illustrated in FIG. 1.

One example embodiment of the beam or girder that is the product of the process described in conjunction with FIG. 1 is shown in FIG. 2. As shown in FIG. 2A, a beam or girder 200 comprises prestressed high strength concrete. The beam or girder is cast on a manufacturing bed (not shown) using a set of forms which determine the shape of the beam or girder. The example beam or girder shown in FIG. 2A has a resulting shape generally referred to as an "I-beam."

Figure 2B:
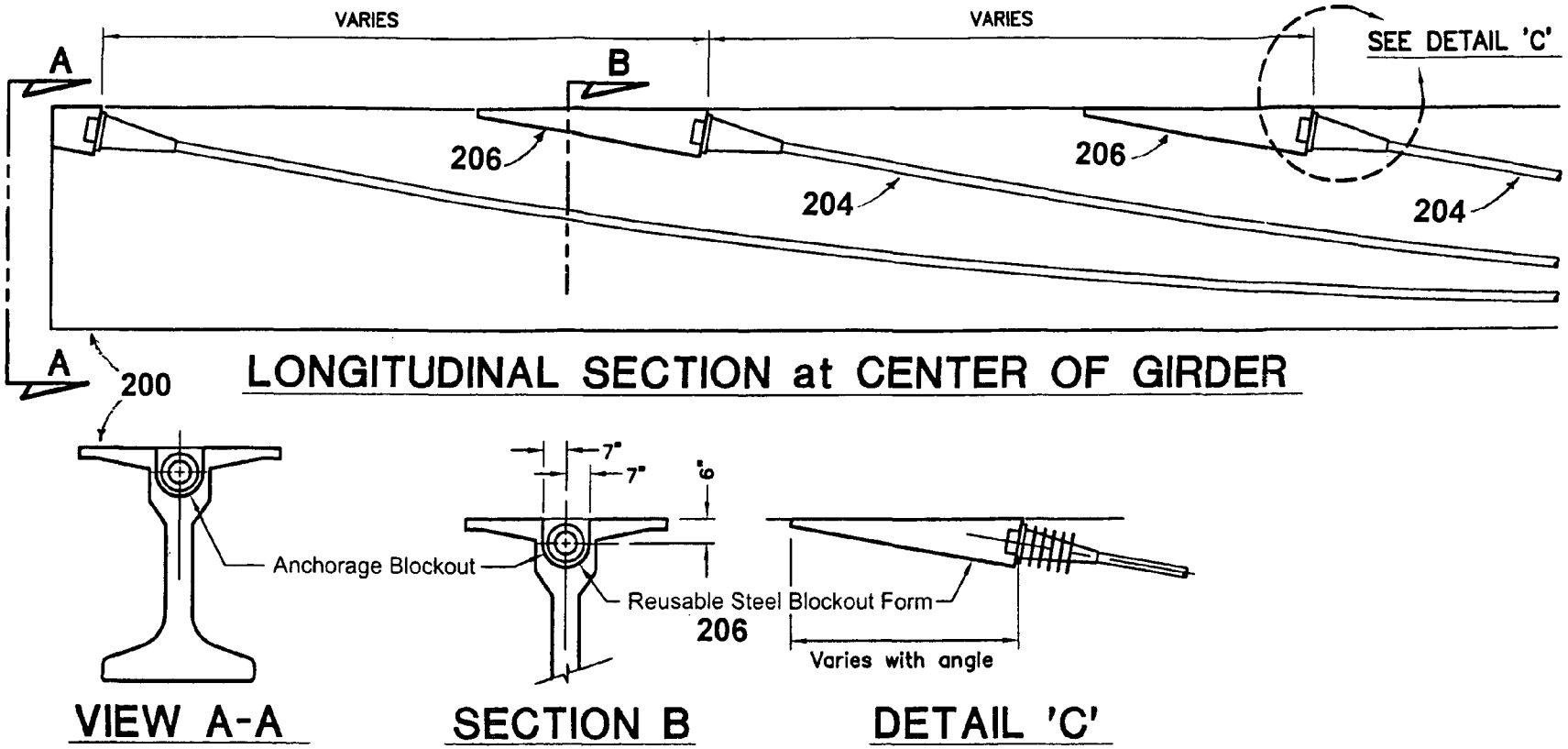

As shown in FIG. 2A, the beam or girder 200 is prestressed during initial manufacture of the beam or girder on the bed using pre-tensioning strands 202 described earlier in conjunction with operations 104 and 106 illustrated in FIG. 1A. The strands 202 are preferably installed on the manufacturing bed prior to the erection of the forms used to contain the high strength concrete. Semi-flexible post-tensioning ducts 204 are also installed as described earlier in conjunction with operation 104 illustrated in FIG. 1A. The post-tensioning ducts 204 terminate at post-tensioning anchorages that may be installed employing reusable blockout forms 206, as shown in FIG. 2B. As shown in FIG. 2B, there may be one or more post-tensioning ducts 204 which are placed into an approximate parabolic curve. Tensile force is then applied to post-tensioning strands inserted through the post-tensioning ducts 204 in operation 136 described earlier to provide the remainder of the required prestressing force for the beam or girder 200.

In accordance with another aspect of the present invention, a beam or girder having sufficient area at the beam or girder ends for accommodating post-tensioning tendons that pass through more than one beam or girder is provided to connect with another beam or girder which is aligned with the first and is located in an adjacent span to form a continuous structural frame. A continuous frame, in which two or more spans are connected, reduces structure cost and makes longer spans possible. Precast beams and girders that are connected by post-tensioning tendons at support points such as piers or columns to make a continuous frame require an area at the beams' or girders' ends to permit "through" tendons to connect adjacent spans. If the area at beam or girder ends is not available due to the presence of post-tensioning anchorages previously placed at the ends of girders in "end blocks", as is the present practice, there is insufficient room for the through tendons to pass through to make the connection. The described beam or girder shape permits locating previously placed tendon anchorages at a distance away from beam or girder ends, thus creating room for tendons to pass through to make a continuous frame.

Figure 3:
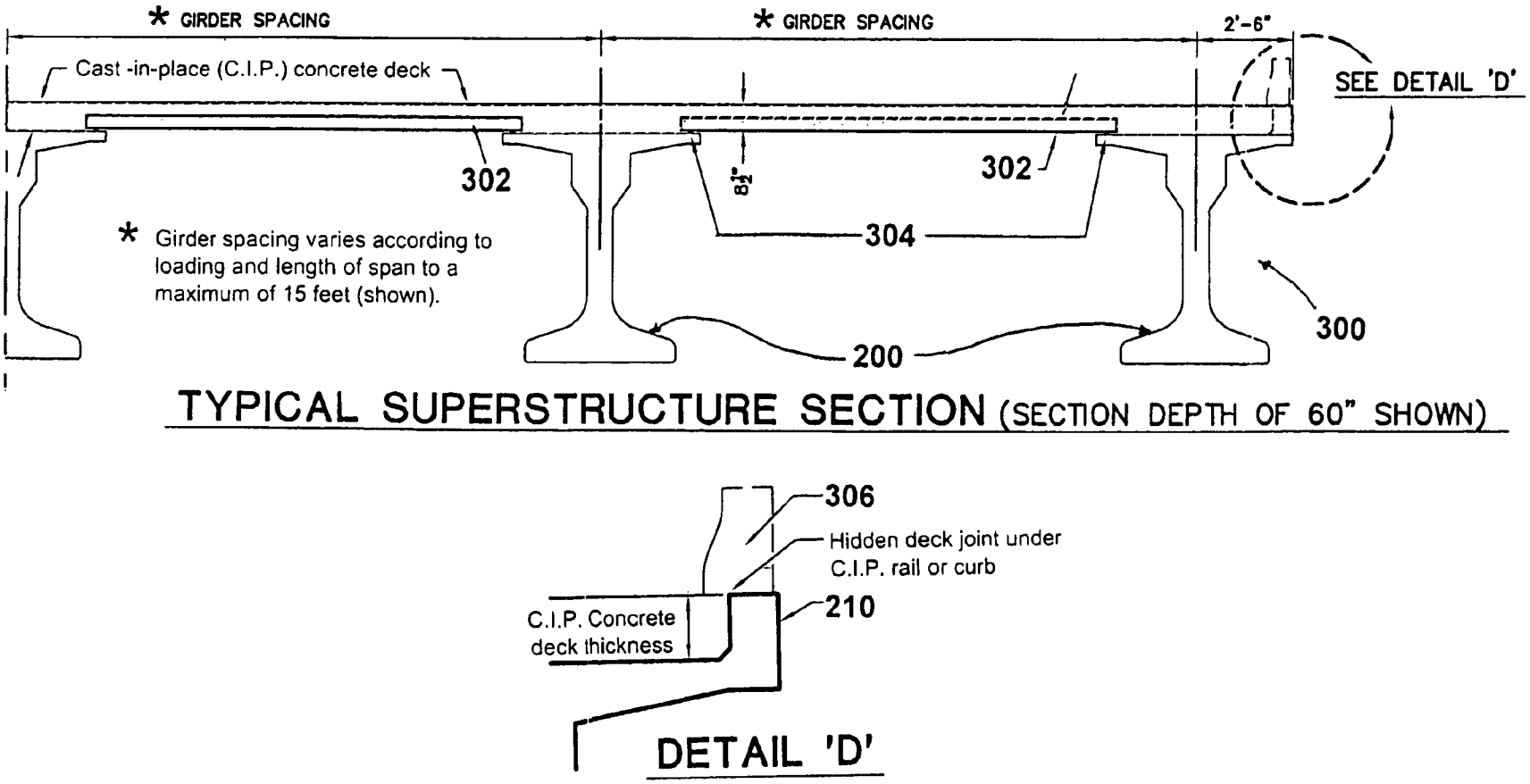
FIG. 3 illustrates a cast-in-place concrete deck comprising the beam or girder shown in FIG. 2.

In accordance with another aspect of the present invention, a plurality of beams or girders 200 can be deployed to construct a cast-in-place concrete deck 300, as shown in FIG. 3. The deck 300 comprises at least two beams or girders 200. The spacing between adjacent beams or girders 200 varies according to loading and length of a span to a maximum spacing, for example, 15 feet. Additionally, the deck 300 comprises one or more deck panels 302. For example, each deck panel 302 may be a four-inch thick prestressed concrete slab. Also, each deck panel 302 may further comprise a continuous neoprene strip 304 at each end of the deck panel in contact with the beams or girders 200 that support the deck panel. Additionally, the outside beam or girder 200 at each edge of the deck 300 is provided with a flange 210 that is preferably precast with the beam or girder. The flange 210 completes the concrete form for the deck 300 and thus retains concrete poured to construct the deck 300, as well as supports a finishing machine (not shown) employed to smooth the surface of concrete poured to complete the deck. As shown in FIG. 3, the flange 210 may also be subsequently employed to support an attached barrier rail or curb 306 of the deck 300 installed at the edge(s) of the deck. The modular elements shown in FIG. 3 enable a bridge superstructure to be built quickly with high quality at low cost. By fabricating beams or girders 200 of higher concrete strength than in the past and using a commensurately higher prestressing force to produce greater structural capacities, significant economy is achieved by requiring fewer beams or girders for a given span and by the elimination of overhang forms and most on-site superstructure formwork by employing the modular elements shown in FIG. 3.

While the foregoing description has been with reference to particular embodiments and contemplated alternative embodiments of the present invention, it will be readily appreciated by those skilled in the art that changes in these embodiments may be made without departing from the principles and spirit of the invention.

What is claimed is:

1. A beam or girder, comprising:

cast concrete using a set of forms to determine a shape of the beam or girder, said beam or girder having a shape that comprises a web having a top, a bottom, and two ends, said web having an enlargement at a top of said web of the beam or girder;

one or more pre-tensioning strands passing through the concrete;

one or more semi-flexible post-tensioning ducts passing through the concrete; and one or more post-tensioning anchorages, said enlarged web accommodating said one or more post-tensioning anchorages for applying one or more post-tensioning forces at selected points along a length of the beam or girder between said two ends, whereby expensive enlargements or end blocks at beam or girder ends are unnecessary.

2. The beam or girder of claim 1 wherein a plurality of partial length post-tensioning tendons are anchored at selected points along the top of the beam or girder, wherein one or more partial length tendons are tensioned to adjust beam or girder camber to a precise value, whereby the beam or girder has a precise elevation along the top for a given span length, whereby the cost of post-tensioning is reduced since tendons are shorter than tendons extending to the beam or girder ends.

3. The beam or girder of claim 1 wherein the shape of the beam or girder at respective ends of the beam or girder has a sufficient area for accommodating post-tensioning tendons that pass through more than one beam or girder to connect a first beam or girder with a second beam or girder which is aligned with the first and is located in an adjacent span to form a continuous structural frame.

4. The beam or girder of claim 1 wherein a plurality of beams or girders is deployed to construct a cast-in-place concrete deck, the deck comprising at least two beams or girders and one or more deck panels, each deck panel comprising a prestressed concrete slab cast in place, and wherein each outside beam or girder at each edge of the deck further comprises a flange to complete a form for the deck that retains concrete poured to construct the deck.

5. The beam or girder of claim 4 wherein the flange is precast with the beam or girder.

6. The beam or girder of claim 4 wherein the flange is employed to support a barrier rail or curb of the deck installed at the edge of the deck.

7. The beam or girder of claim 1 wherein said concrete comprises a material having a high cementitious content.

8. The beam or girder of claim 7 wherein said cementitious material comprises Portland Cement.

9. The beam or girder of claim 7, further comprising water-reducing and plasticizing admixtures.

10. The beam or girder of claim 7, further comprising an alkalinity reducing material selected from the group of alkalinity reducing materials consisting of fly ash and slag.

11. The beam or girder of claim 1 wherein said shape of the beam or girder is an I-beam shape having a first portion through which said pre-tensioning strands pass and a second portion through which said post-tensioning ducts pass.

12. The beam or girder of claim 1 wherein said one or more post-tensioning anchorages are formed in said enlarged web by reusable blockout forms.

13. The beam or girder of claim 1 wherein said one or more post-tensioning ducts are formed into an approximate parabolic curve.

14. The beam or girder of claim 4, further comprising a continuous neoprene strip at each end of each deck panel in contact with the beams or girders that support the panel.

* * * * *